United States Patent [19]

Hitchmough et al.

[11] 3,963,843

[45] June 15, 1976

[54] PRODUCTION OF COATED PAPER

[75] Inventors: John R. Hitchmough, Baie d'Urfe; Clyde Arthur Wetmore, Cornwall, both of Canada

[73] Assignee: Domtar Limited, Montreal, Canada

[22] Filed: Jan. 10, 1974

[21] Appl. No.: 425,101

[52] U.S. Cl. ..... 427/361; 427/365; 427/366

[51] Int. Cl.[2] ..... B05D 3/12

[58] Field of Search ..... 117/64 R, 64 C, 155 UA; 427/361, 362, 365, 366

[56] References Cited

UNITED STATES PATENTS

| | | | |
|---|---|---|---|
| 2,759,847 | 8/1956 | Frost et al. | 117/64 C |
| 2,919,205 | 12/1959 | Hart | 117/64 C |
| 3,028,258 | 4/1962 | Rice | 117/64 C |
| 3,222,209 | 12/1965 | Brundige et al. | 117/64 R |
| 3,268,354 | 8/1966 | Hain | 117/64 C |
| 3,281,267 | 10/1966 | Rice | 17/155 |
| 3,338,734 | 8/1967 | Goff et al. | 117/64 R |
| 3,338,736 | 8/1967 | Hain | 117/64 R |
| 3,575,707 | 4/1971 | Ploetz et al. | 117/64 C |

*Primary Examiner*—Michael R. Lusignan
*Attorney, Agent, or Firm*—C. A. Rowley

[57] ABSTRACT

A coated paper having a finished surface of improved printability and glueability is produced by applying the coating to a paper web, drying the coated web and passing the dried coated web through a pressure nip in contact with a heated finishing drum. The coating contains an all-synthetic, thermoplastic resin binder and a very small amount of release agent.

9 Claims, 9 Drawing Figures

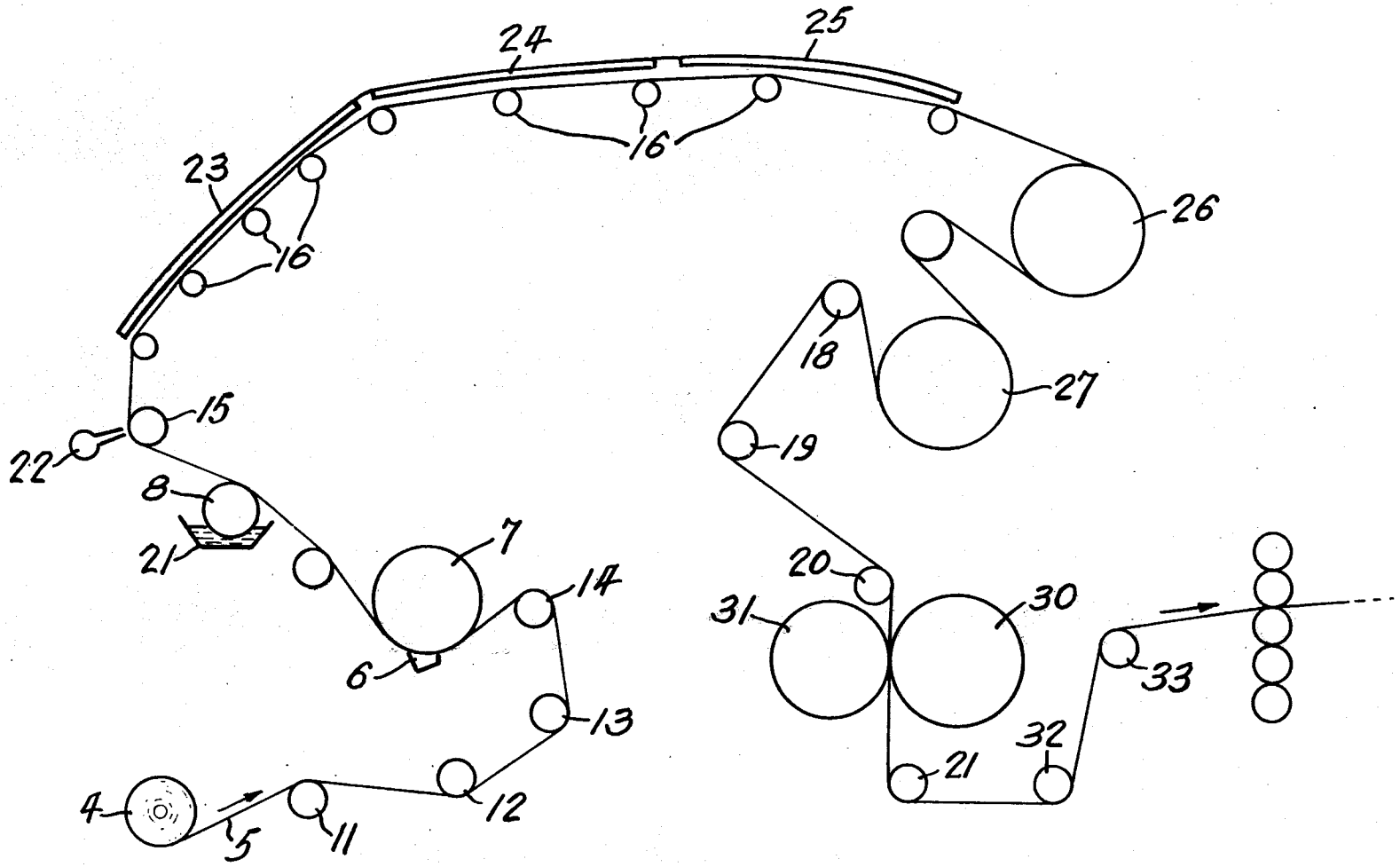
26
27
25
24
23
16
16
18
19
20
30
31
32
21
33
14
13
7
6
12
11
5
4
15
8
21
22

PRODUCTION OF COATED PAPER

FIELD OF THE INVENTION

The present invention relates to coated paper or board. It relates more particularly to coated, drum-finished paper or board having a mineral coating with a synthetic polymer, and to a process for the production thereof.

DESCRIPTION OF THE PRIOR ART

Various techniques have been used for the finishing of coating on paper to provide coated papers with desirable surface properties, particularly in respect of gloss, smoothness, printability and the like. One known technique for obtaining high-gloss paper (described e.g. in Canadian Pat. No. 579,191) consists in contacting the coated surface of paper, while still in the plastic state, with a polished heated metal surface, e.g. by passing the coated paper, while the coating is still substantially wet, through a pressure nip between a heated metal drum and a backing roll to smooth the surface while it is dried and thus permanently set.

Paper coatings are conventionally made of one or more inorganic pigments, such as kaolin clay, calcium carbonate, titanium dioxide and the like, and a minor proportion of a binder, usually starch, casein or soya protein, often with a latex co-binder, and various additives. Passing such coated paper at substantial moisture levels through a pressure nip in contact with a heated surface would normally tend to disrupt the coating, and techniques had to be developed to prevent such disruption. An example of such a technique is passing of the coated paper, after partial drying, through an acid bath to "gel" the surface of the coating and to make it retain its cohesion and integrity during the passage through the heated nip. However, such elaborate procedures tend to slow down production and render the operation economically unattractive.

It is known to use synthetic polymer binders in conjunction with the more conventional protein binders and it has also been proposed to use synthetic resins as sole binders. Canadian Pat. No. 647,825, Rice, provides coated paper wherein the coating includes a thermoplastic resinous component and where the coated web is molded against a polished metal surface with a resilient backing, e.g. in a nip between two roll surfaces. Canadian Pat. No. 719,670 provides coated paper wherein the coating comprises a major proportion of filler, and a minor proportion of non-water absorptive thermoplastic resin particles, and the applied coating is treated to bring it into a non-equilibrium moisture condition such that it is dry to the touch but wet at the boundary with the substrate, and in this condition the coated paper is passed through a high pressure nip between turning rolls. Canadian Pat. No. 909,607 discloses a method wherein the paper web is first coated with an intermediate coating containing a non-thermoplastic binder, then with a top coating containing a thermoplastic binder, and the coating while still appreciably wet, is finished by passing through a gloss calender nip.

These methods have so far found limited application and the use of coatings having all-synthetic binders has not grown as might have been expected, because difficulties have been encountered in operation and also in meeting the exacting standards of quality, notably in respect of smoothness, gloss, printability, gluability, etc., which such coated papers must meet to be acceptable for the many uses currently made of such papers.

SUMMARY OF THE INVENTION

The present invention provides a method of producing coated paper of high gloss and smoothness and at very favourable production speeds. Gloss readings of 40 and more can be obtained by the passage of coated papers of this invention through a single pressure nip, and the surface of such papers exhibits excellent printability and affinity for the glues commonly used. The method is simpler than older methods, in that only a single type binder system is used throughout the coating operation, and as the system can be easily adjusted to suit different substrates, this method affords great flexibility and ease of operation.

According to the invention a coated paper having a finished surface is produced by applying onto a fibrous cellulosic web a layer of a coating composition consisting essentially of a mineral pigment and a synthetic thermoplastic alkali-swellable water retentive resin, drying the wet coated web to a uniformly low moisture content and passing the dried coated web through a nip formed between two rolls, one of which has a heated, smooth finishing surface. The drying of the wet coating is an essential step according to the invention and is carried to appreciably greater length than in prior art processes. When the moisture content of the coated web is reduced to about 4-6%, the tendency of the coating to stick to the surface of the finishing roll is drastically reduced and minute quantities of a lubricant or release agent are then sufficient to ensure that no sticking occurs. It has been found that the use of lubricant in the relatively larger amounts required when the coating is appreciably wet, often has a deleterious effect on the printability and other important characteristics of the coated web, and it is a feature of the invention that by carrying out the finishing step at a much reduced moisture level in the coated web, it becomes possible to reduce very substantially the amount of release agent applied with the coating, and thus to remove a deficiency common in the prior art. The thermoplastic alkali-swellable resin binder is preferably a rubbery polymer latex, for example a butadiene-styrene copolymer carboxylated by copolymerization with a carboxylic acid and suitably selected to yield, after passage of the coated web through the heated nip, a surface of desirable porosity for ink and/or glue receptivity, yet smooth and glossy. A single layer of coating of suitable weight may be applied but, preferably, the coating is applied in two successive layers, the first of these being desirably smoothed with a blade coater to obtain a level surface upon which the second coating is applied.

In the accompanying drawing, the single FIGURE is a diagrammatic view illustrating the method of the invention.

DESCRIPTION OF THE PREFERRED EMBODIMENTS

In accordance with the invention, a fibrous cellulosic web is coated with a coating composition consisting essentially of an inorganic pigment and a thermoplastic synthetic resin binder in an aqueous system. The coating is applied to the substrate in a conventional manner by an off-machine or on-machine procedure, as desired. It is preferable to supply the coating in two layers, the first serving to smooth out the surface of the substrate, while the second provides the weight, thickness and surface desired. The first layer may be applied with a blade coater positioned to contact the travelling web and to level the coating applied. The blade not only scrapes off the excess coating composition over and above the thickness required, but also helps, through the slight pressure applied, to distribute the coating over the surface of the substrate and to render it smooth by filling the crevasses and levelling out the peaks and valleys on the surface. A relatively thin layer of coating may be sufficient for the purpose and a weight of coating of the order of 1 to 4 lbs. solids per 2600 sq.ft. is preferred. The viscosity of the composition will be such as to permit efficient application, and the consistency of the composition to be applied will be between 50 and 60% solids. The second layer can be applied immediately on the first layer while the latter is still wet. This second layer consists essentially of the same composition, but is preferrably of a somewhat lower solids content, e.g. 40 to 50%. The second layer is preferably applied in greater weight, e.g. 6 to 12 lbs. solids per 2600 sq.ft., depending on the total weight of the coating desired. The second coating layer is applied in any desirable manner and may be smoothed, e.g. with an air knife apparatus, to obtain a level uniform surface.

Following the application of the coating, the coated web is dried, e.g. by passing the coated web through hot air driers, followed by heated rolls, or in any other suitable manner. Care is taken to carry out the drying in a gradual and uniform manner and at temperatures not exceeding 350°F, so as to prevent, as far as possible, uneven distribution of moisture through the web as well as uneven distribution of the binder through the coating layer, and to prevent mottling and blistering of the board. For example, where the drying was done in a three-stage air tunnel dryer, the air temperature was the same throughout the dryer, but differential air velocities were used in the three stages with the lowest velocity in the first stage, a higher velocity in the next and so on. In this manner, a drying gradient is established which provides for gradual and substantially uniform drying and prevents "case-hardening" of the coating and deterioration of the bond between the rawstock and the coating, undesirable phenomena that may occur due to binder migration to the surface of the coating in the event of sudden evaporation. The dryer air temperature is suitably selected and coordinated with the residence time in the dryer to achieve the necessary dryness. The complete drying line may further include drying rolls or the like. The resulting moisture content of the dried coated web should not exceed 6% and is preferably about 4 to 6%, i.e., the coated web is substantially drier than a web exposed for any length of time to the ambient air. The dry coated web is not remoistened but is passed directly to the nip between a pair of turning finishing rolls.

The finishing rolls are of a known type and sometimes referred to as "gloss calender". One of the rolls is provided with a heated metal finishing surface of desired smoothness or polish, and the treated coated web is made to pass through the nip so that the surface of the coating comes in momentary contact under pressure with the heated finishing surface. The other roll is generally provided with an outer cover of hard rubber or pressed cotton, or a similarly deformable yet hard material, and the nip is adjusted to provide the desired pressure therein for the finishing of the paper. The temperature of the finishing roll is maintained between 200° and 350°F and the pressure is between 300 and 800 lbs. per linear inch with the cross-sectional width of the nip generally not exceeding 1 inch. A preferred range of temperature is between 225° and 300°F and the preferred pressure range is between 400 and 600 p.l.i.

The coated web is directed straight into the nip and is not made to contact or wrap around the heated finishing roll either before or after the nip. Thus the contact between the surface of the coating and the heated finishing surface is momentary, i.e., only at the nip and with the contemplated speeds of the web of up to 1000 ft. per minute the time of contact is very short indeed. By the time the coated web reaches the nip, the coating is substantially completely dry and substantially set. Upon contact with the heated metal surface the surface of the coating becomes softened or plasticized and is easily deformable under the pressure applied by the two rolls. The surface thus becomes level and smooth.

Upon leavng the nip the coated web separates neatly from the finishing roll, and the surface rapidly cools and acquires its permanent set. The degree of smoothness or gloss which the coating acquires depends on a number of variables, relating not only to the calendering operation, but also to the composition of the coating, the state of the rawstock and the like. Hunter gloss of 35 – 45% and a Sheffield smoothness 30–100 cc/min. can be obtained in a single nip operation. The printability is excellent and the K & N ink hold out is about 65–75. The sheet varnishes easily and there is no varnish crawling or mottle.

The cellulosic webs suitable for coating in accordance with this invention can be of any weight or type normally used for the making of coated paper or board. They can be of bleached or unbleached stock and can vary in weight from light papers, such as 20No./3 MSF and a caliper of 2.3 thousandths, to boards of a weight of 260No./2.6 MSF and caliper 24 thousandths. The webs may be sized or unsized and may contain other additives, fillers, modifiers, and the like, either incorporated in the body of the substrate or applied to the surface thereof, and the coated papers can be turned to a variety of uses, e.g. as cigarette cartons, vending machine packages, cards, etc., and lightweight paper such as food wrapping, magazine stock and the like.

The coating compositions of this invention contain as basic ingredients a finely divided paper coating pigment and an alkali-swellable thermoplastic resin binder, all intimately mixed in the form of an aqueous suspension system which also includes other minor ingredients such as defoamers, release agents and the like. The pigment consists in most cases of a refined clay of a fine particle size, but it may also contain various admixtures with the clay, such as calcium carbonate, titanium dioxide, hydrated alumina and the like. These and other mineral pigments may be added to the clay in various proportions to achieve variation in the brightness or whiteness of the coating or for other purposes. Paper coating clays are available in various grades based primarily on the size distribution of the clay particles, those clays ranking highest which have the highest proportion of delaminated fine particles, say, particles less than 2 microns equivalent diameter.

The thermoplastic resin binders of this invention are preferably rubbery polymers, e.g. co-polymers of styrene with an aliphatic conjugated diene, such as butadiene or a substituted butadiene and preferably designed to have water retention characteristics under alkaline conditions, such properties being imparted, e.g. by carboxylating the co-polymer with a suitable carboxylic acid. The co-polymer is preferably in the form of a suspension of fine particles in water, or a latex. The property of being alkali-swellable is important in the binder as it provides for the retention of water within the coating after application of the coating and the prevention of drainage of water from the coating into the substrate. Examples of latexes suitable for use in the invention are "Dow Latex 650" and "Dow Latex 680," both articles of commerce sold by the Dow Chemical Company, both being co-polymers of styrene and butadiene modified with carboxylic acids. The first latex is a co-polymer designed to be alkali swellable, while the second has characteristically large and irregularly shaped particles and can be used in various proportions to modify the porosity and receptivity of the coating. It is preferred to use a mixture of the two latexes, as in this manner coatings of different porosities can be prepared and the properties of the coated paper can be varied depending on the type of substrate, end use of the paper, etc. Another type of latex which is suitable is an acrylated vinyl acetate sold by Rohm & Hass Company under the name "Rhoplex AR-74" ("Rhoplex" is a Registered Trade Mark of the Rohm & Haas Company). Other polymers suitable for use in the invention will be evident to those skilled in the art.

Included in the coating composition is a small quantity of a release agent which will prevent sticking of the coated surface to the heated roll surface. Such lubricants or release agents are well known in the art, examples being calcium stearate, potassium oleate and the like. Other ingredients of the coating compositions may include various additives such as defoaming agents, dispersants, involubilizers (such as a melamine formaldehyde resin) and if desired dyes, optical brighteners and the like. The proportions of the various ingredients may be varied depending on the properties aimed at, but I have found the following proportions advantageous, all on a solids weight basis: Mineral pigment (clay, calcium carbonate and the like) 100 parts; resin particles, 15–30 parts; lubricant (calcium stearate), 0.1–1.0 parts (preferably 0.15 to 0.75 parts); insolubilizer 0.25–1.5 parts. The ingredients are thoroughly mixed in water, the suspension is brought to the desired consistency for application, and the pH of the mixture is adjusted with ammonia or alkali to a pH between 7 and 8. It is essential that the pH be thus adjusted to a value slightly on the alkaline side to swell the alkali sensitive polymer particles and give the necessary degree of water retention to the coating.

The operation will be further described with reference to the accompanying Figure which is simplified diagrammatic representation of the sequence of steps in the process. A paper web 5 is unwound from roll 4 and led over guide rolls 11, 12, 13 and 14 to a first coating station where the coating is applied by a blade coater 6 while the web is supported by backing roll 7. A relatively light layer of coating is applied to the web at this stage and the flexible blade distributes the coating uniformly and smoothly over the initially rough surface of the substrate. The coating material may be supplied to the coating station 6 in any convenient way (not shown). The web coated web passes then to a second coating station. This consists of applicator roll 8 mounted to dip in container 21 containing the coating composition to be applied as second layer. Immediately upon leaving the coater, the web is passed over backing roll 15 in front of an air jet coming from air-knife 22 which removes the excess coating applied by applicator 8.

The coated web then passes through a drying installation which in the illustrated embodiment consists of a first hot air drying section 23, a second hot air drying section 24, and a third hot air drying section 25. The web is conveyed through these dryer sections supported on rolls 16. After the air dryer, the coated web is further dried on drum driers 26 and 27. Other arrangements are of course possible for the drying of the coated web to the desired low moisture content. The dried web is then led over guide rolls 18, 19 and 20 into the nip between heated finishing roll 30 and pressure roll 31. Finishing roll 30 is provided with a metal surface of desired smoothness and finish and is heated in any convenient way (not shown) to a finishing temperature as hereinabove discussed. Roll 31 is rubber covered and is mounted to form a pressure nip, as hereinabove indicated, means (not shown) being provided to regulate the pressure as required.

The web issuing from the nip is guided by roll 31 to obviate any tendency to stay in contact with roll 30 and is then passed over guiding rolls 32 and 33 to a conventional finishing operation that may be desired.

The invention will be further illustrated by the following Examples.

EXAMPLE I

A paper stock of a weight of 136 lbs. per 2600 sq.ft. was coated on one side with a layer of a coating composition consisting of the following (on a dry basis weight of solids):

| | |
|---|---|
| Clay | 100.0 parts |
| Carboxylated styrene-butadiene co-polymer | |
| "Dow Latex-650" (46% suspension) | 12.1 parts |
| "Dow Latex-680" (48% suspension) | 8.0 parts |
| Calcium stearate (50% suspension) | .25 parts |
| Melamine-formaldehyde ("Parez 707") | .8 parts |
| Water in amount to form a suspension of 60% solids. | |

The clay was pre-dispersed in 45 parts of water using 0.1 trisodium pyrophosphate as dispersing agent. All ingredients were thoroughly mixed and the pH of the suspension was adjusted by means of ammonia to a pH 7–7.5.

The composition was applied by means of a Flexiblade to a weight of 2 lbs/2600 sq.ft. The web thus coated was passed to an air-knife coater where the balance of the coating (8 lbs/2600 sq.ft.) was applied. The coating applied with the air-knife has the same composition as above, but had a lower consistency namely about 50% solids.

The coated web was now sent into a three-stage medium velocity air tunnel drier adapted to operate at air velocities 7,000—15,000 ft/min. The air temperature in the drier was about 300°F, but a differential was maintained in the air velocity in the various sections by means of baffles installed in the tunnel and fully opened in the third section, but only one-quarter open in the first and three-quarters open in the second. The residence time of the web in the tunnel was about 5 seconds. From the tunnel, the web was passed around two drying rolls maintained at a temperature of about 200°F to complete the drying.

The dried web was passed through a single nip of a gloss calender. The moisture content of the web on entering the nip was about 5% as measured by a moisture unit located on the coated side of the web just prior to the nip. The finishing roll was maintained at 250°F and the web travelled through the nip at 500 ft./min. The web issuing from the gloss calender was moistened on the reverse side for purposes of curl control and passed through a calender stack and then reeled up on a conventional drum winder. The finished coated paper had a gloss of 40 Hunter, and excellent ink receptivity and affinity for glues.

EXAMPLE II

A paper stock of a weight of 136 lbs/2600 sq.ft. was coated substantially in the same manner as in Example I with a composition having the following formulation (in parts by weight, dry solids):

| | |
|---|---|
| Clay | 80.0 parts |
| Calcium carbonate (Purecal-O) | 10.0 parts |
| Titanium dioxide (Titanox AWD) | 10.0 parts |
| Carboxylated styrene-butadiene (blend of Dow Latex-650 and Dow Latex-680) | 20.0 parts |
| Calcium stearate | 0.30 parts |
| Melamine-formaldehyde (Parez 707) | 0.8 parts |
| Water in amount to make a suspension of 60% solids and 50% solids respectively for flexible coater and air-knife coater | |

The pigments were dispersed separately in a Cowles disperser: Clay in 34 parts of water using 0.08 parts of trisodium pyrophosphate as dispersing agent, and calcium carbonate in 4.3 parts of water using composition T as dispersant. The pigment dispersions were blended under low shear and the two Dow Latexes were added in the ratio of 3 Dow-650 to 2 Dow-680. The pH was raised to 7 with ammonia and two coating layers were applied onto the web and the coated web was dried and gloss calendered as in Example I. The finished paper had a gloss of 40 and had excellent printability and affinity for glues.

What we claim is:

1. A method of producing a coated paper having a finished surface of high smoothness and improved printability and glueability comprising coating a fibrous cellulosic web with an aqueous coating composition consisting essentially of a major proportion of an inorganic filler, a minor proportion of a thermoplastic alkali-swelled water retentive synthetic resin binder and a small amount of a release agent, gradually drying said coated web substantially uniformly to a moisture content of not more than 6% and to obtain a relatively uniform distribution of binder through the coating layer, thereafter directly passing said dried coated web through a pressure nip with said coating layer in contact with a finishing roll having a surface heated to a temperature of between 200° to 300°F, and discontinuing contact of said web with said finishing roll immediately past said nip, said small amounts of release agent being sufficient to prevent sticking of the coated surface to the heated roll surface.

2. The method of claim 1 wherein the synthetic resin binder is a carboxylated co-polymer of styrene and butadiene.

3. The method of claim 1 wherein the release agent is calcium stearate present in an amount between 0.1 and 1% based on the weight of the pigment.

4. The method of claim 3 wherein the release agent is present in an amount between 0.15 and 0.75% based on the weight of the pigment.

5. The method of claim 1 wherein the synthetic resin binder is present in the coating composition in an amount between 15 and 30% of the weight of the pigment.

6. The method of claim 1 wherein the pigment consists of between 70 and 100% of paper coating clay, the remainder being one or more of the group consisting of calcium carbonate, titanium dioxide and aluminum oxide.

7. The method of claim 1 wherein the coated web is dried gradually and substantially uniformly in a hot air drier followed by heated rolls, to a moisture content between 3 and 6%.

8. The method of claim 1 wherein the coating is applied in two consecutive layers, the first layer being applied by a blade coater, the weight of said layer being between 1 and 4 lbs. solids per 2600 sq.ft.

9. The method of claim 1 wherein the pressure at the nip is between 300 and 800 p.l.i.

* * * * *